US009300068B2

(12) United States Patent
Mongold et al.

(10) Patent No.: US 9,300,068 B2
(45) Date of Patent: Mar. 29, 2016

(54) EDGECARD CONNECTOR WITH COMMON-END DATUM TO REDUCE MISALIGNMENT TOLERANCES

(71) Applicant: Samtec, Inc., New Albany, IN (US)

(72) Inventors: John Allen Mongold, Todd, PA (US); Brian R. Vicich, Prospect, KY (US); Donald Christopher Knowlden, Harrisburg, PA (US)

(73) Assignee: Samtec, Inc., New Albany ( * ) Notice: Subject to any disclaimer, the term of this patent is extended or adjusted under 35 U.S.C. 154(b) by 0 days.

(21) Appl. No.: 14/463,721

(22) Filed: Aug. 20, 2014

(65) Prior Publication Data

US 2016/0056562 A1 Feb. 25, 2016

(51) Int. Cl.
*H01R 12/91* (2011.01)
*H01R 12/72* (2011.01)

(52) U.S. Cl.
CPC ..... *H01R 12/91* (2013.01); *H01R 12/721* (2013.01)

(58) Field of Classification Search
CPC ..... G06K 7/0021; H01R 27/00; H01R 12/721
See application file for complete search history.

(56) References Cited

U.S. PATENT DOCUMENTS

| | | | | |
|---|---|---|---|---|
| 4,776,805 | A | 10/1988 | Brown et al. | |
| 5,161,983 | A * | 11/1992 | Ohno | H05K 7/1084 439/330 |
| 5,387,133 | A * | 2/1995 | Tondreault | H01R 12/721 439/637 |
| 6,203,328 | B1 * | 3/2001 | Ortega | H01R 12/721 439/60 |
| 8,465,308 | B2 * | 6/2013 | Gao | H01R 12/721 439/188 |
| 2005/0095916 | A1 * | 5/2005 | Lai | H01R 12/7094 439/630 |

* cited by examiner

*Primary Examiner* — Gary Paumen
(74) *Attorney, Agent, or Firm* — Keating & Bennett, LLP

(57) ABSTRACT

A connector includes a body, a slot within the body configured to receive a substrate and including a first end and a second end, contacts arranged along the slot between the first end and the second end, and a biasing mechanism arranged at the first end to align the substrate as the substrate is inserted into the slot so that substrate is in contact with the second end when the substrate is fully inserted into the slot.

22 Claims, 8 Drawing Sheets

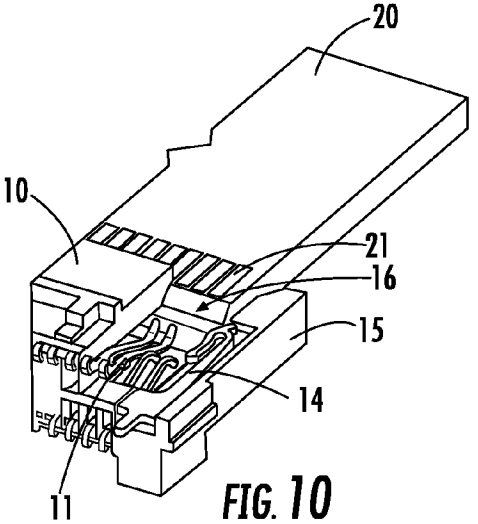
FIG. 10
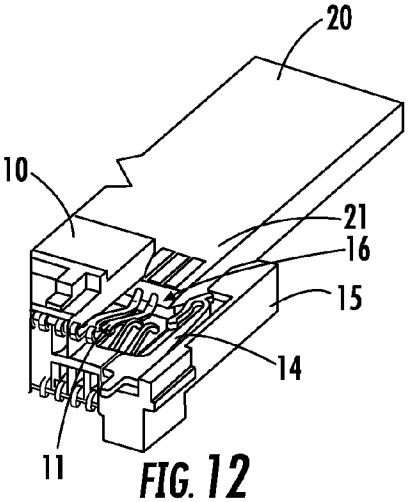
FIG. 12
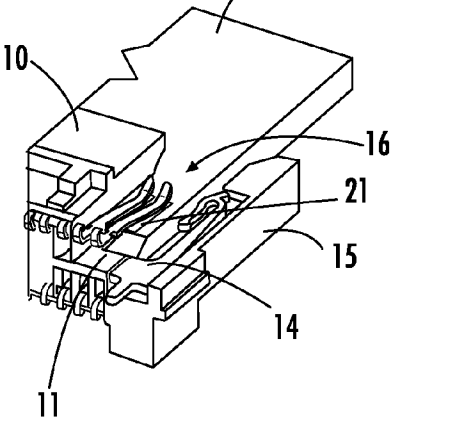
FIG. 14
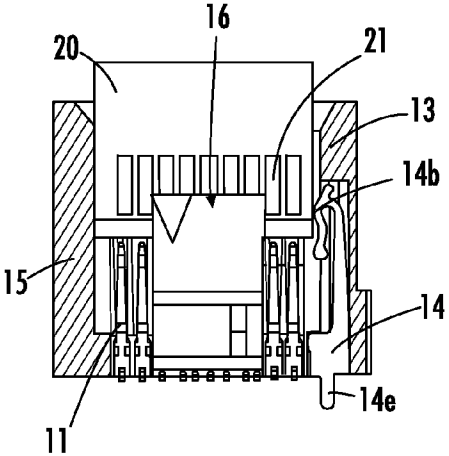
FIG. 11
FIG. 13
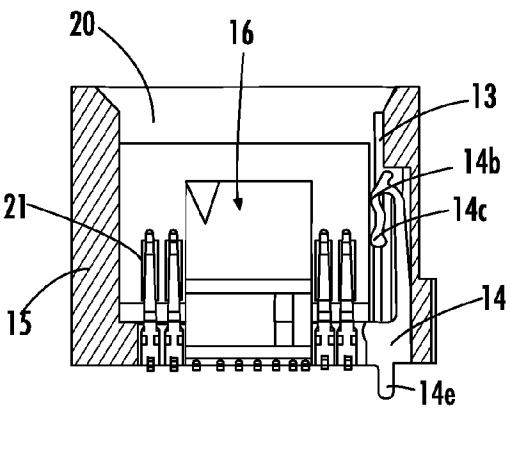
FIG. 15

EDGECARD CONNECTOR WITH COMMON-END DATUM TO REDUCE MISALIGNMENT TOLERANCES

BACKGROUND OF THE INVENTION

1. Field of the Invention

The present invention relates to edgecards and edgecard connectors. More specifically, the present invention relates to edgecards and edgecard connectors with a biasing mechanism to reduce misalignment tolerances between contacts in the edgecard connectors and pads on the edgecards.

2. Description of the Related Art

Edgecards are typically manufactured from printed circuit boards (PCBs) and include surface pads that provide connection to electrical paths called traces on or within the edgecard. The edgecard is inserted into an edgecard connector so that the pads engage with the contacts in the edgecard connector to form a physical and an electrical connection. The distance between adjacent pads, i.e. pad pitch, on the edgecard is typically selected to be the same as the distance between adjacent contacts, i.e., contact pitch, in the edgecard connector.

FIGS. 1 and 2 show an edgecard 200 inserted into a known edgecard connector 100. The edgecard 200 includes a slot 202 for aligning the edgecard 200 with the edgecard connector 100 and includes pads 201 arranged along the edge of the surface of the edgecard 200. For simplicity, the edgecard 200 does not show any traces; however, the edgecard 200 could have surface or interior traces that connect to the pads 201. The edgecard connector 100 includes contacts 101 and alignment pins 102 to align the edgecard connector 100 with a PCB (not shown) when the edgecard connector 100 is connected to the PCB.

Manufacturing tolerances limit how small the pad pitch of an edgecard can be. The tolerances of the pad pitch and the trace routing cannot be controlled within a small enough range, i.e. within tight enough tolerance, for pitches less than 0.8 mm without problems with misalignment between the pads on the edgecard and the contacts of the edgecard connector. This misalignment can result in loss of contact and/or shorting to the adjacent pad. These problems and misalignment are shown with respect to the known edgecard connector 100 in Prior Art FIGS. 1-9.

FIGS. 1 and 2 show the edgecard 200 ideally inserted into the edgecard connector 100 so that the edgecard 200 is centered with respect to the edgecard connector 100 with equal space 103 on each side of the edgecard 200. FIGS. 3-9 show the problems that occur when the edgecard 200 is not ideally centered with respect to the edgecard connector 100.

FIGS. 1 and 2 show the edgecard 200 with ideal float in the slot of the body of the edgecard connector 100 in which the edgecard 200 is center aligned with respect to the edgecard connector 100 so that the spaces 103 on the left and right sides of the edgecard connector 100 are the same. The amount of float is determined by the manufacturing tolerances of the edgecard connector 100 and the edgecard 200. Known float is designed about the center of the edgecard connector 100, and the edgecard 200 can float right or left within the confines of the slot in the edgecard connector 100. This float contributes to the misalignment problems. Because the ideal float of the edgecard connector 100 is center aligned, the pads 201 of the edgecard 200 are also center aligned. The edgecard 200 is ideally centered in FIGS. 1 and 2, allowing for the pad 201 to be centered with the contact 101. Ideally, the edgecard 200 is centered in the edgecard connector 100 throughout the entire mating process.

FIGS. 3-5 shows a type of misalignment in which the edgecard 200 is not centered with the edgecard connector 100 and is aligned with the far left edge of the slot in the edgecard connector 100. That is, the entire float is to right side so that the space 103 in FIGS. 3 and 4 is twice the size of the spaces 103 in FIGS. 1 and 2. As shown in FIG. 5, the pad 201 and the contact 101 are misaligned. Misalignment can result in the contact 101 falling off the edge of the respective pad 201 or even touching an adjacent pad 201.

FIGS. 6-9 show a type of misalignment in which the edgecard 200 is skewed with respect to the edgecard connector 200 so that the edgecard 100 is angularly misaligned with respect to the edgecard connector 100. The float allows the edgecard 100 to become skewed during the mating sequence, and the pad 201 and the contact 101 are also angularly misaligned. In angular misalignment, the beam of the contact 101 can catch the edge of the pad 201, and the pad 201 can dig into the beam of the contact 101, locking the contact 101 into a permanent misalignment or permanently bending the beam of the contact 101.

These misalignment problems can be addressed by manufacturing edgecards and edgecard connectors with tighter tolerances. However, this increases the cost of manufacturing the edgecards and edgecard connectors.

SUMMARY OF THE INVENTION

To overcome the problems described above, preferred embodiments of the present invention provide an edgecard connector with a biasing mechanism that significantly reduces or prevents misalignment tolerances between contacts in the edgecard connectors and pads on the edgecard and that achieves a small contact pitch capable of being used with edgecards that have been manufactured without tight tolerances.

According to a preferred embodiment of the present invention, a connector includes a body, a slot within the body configured to receive a substrate and including a first end and a second end, contacts arranged along the slot between the first end and the second end, and a biasing mechanism arranged at the first end to align the substrate as the substrate is inserted into the slot so that substrate is in contact with the second end when the substrate is fully inserted into the slot.

The substrate is preferably an edgecard. Preferably, the substrate includes pads, and when the substrate is fully inserted into the slot, the contacts are aligned with the pads.

The biasing mechanism is preferably configured to push the substrate with increasing force as the substrate is inserted into the connector. The biasing mechanism preferably includes two contact points that engage the substrate as the substrate is inserted into the slot. The biasing mechanism preferably includes one point of contact that engages the substrate as the substrate is inserted into the slot. The biasing mechanism preferably includes an anti-stubbing wing. Preferably, the biasing mechanism includes a through-hole solder tail or a surface-mount solder tail. The biasing mechanism preferably includes a cantilevered beam or a dimple.

According to a preferred embodiment of the present invention, a connector system includes a mounting substrate and a connector as described herein mounted to the mounting substrate.

According to a preferred embodiment of the present invention, a connector system includes a connector as described herein and a substrate inserted into the slot of the substrate.

The above and other features, elements, characteristics, steps, and advantages of the present invention will become more apparent from the following detailed description of preferred embodiments of the present invention with reference to the attached drawings.

BRIEF DESCRIPTION OF THE DRAWINGS

FIGS. 10-15 show a substrate being inserted into a connector according to a first preferred embodiment of the present invention.

DETAILED DESCRIPTION OF PREFERRED EMBODIMENTS

Figure 1:
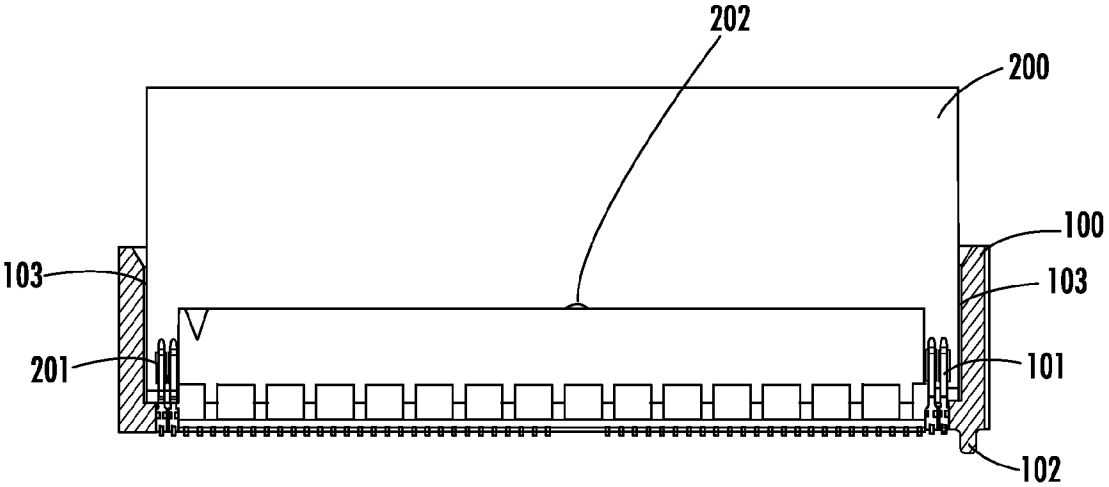
FIG. 1 PRIOR ART
FIG. 1 is a partial sectional view of a prior art connector with a centered edgecard.

Preferred embodiments of the present invention are shown in FIGS. 10-33. Instead of having a centered ideal float, the connectors according to the preferred embodiments of the present invention have the ideal float aligned with one of the edges of the slot in the connector by biasing the edgecard to one side of the connector. This will be referred to as "edge aligned."

Preferred embodiments of the present invention preferably use different biasing mechanisms to align the edgecard within the connector. It should be understood that other biasing mechanisms could be used as the biasing mechanism. The biasing mechanism preferably provides an increasing amount of force as the edgecard is inserted into the slot to help with insertion of the edgecard and to reduce the chance of rotating the edgecard due to unequal forces on the edges of the edgecard. The force of the biasing mechanism preferably increases as the edgecard is inserted into the slot to ensure that the edgecard is fully biased against one edge of the slot, i.e. fully edge aligned.

Instead of having pads that are center aligned on the edgecard, edgecards that can be used with the connectors according to the preferred embodiments of the present invention preferably include pads that are aligned with respect to one edge of the edgecard, i.e. edge aligned. Edge-aligned pads on an edgecard are easier and cheaper to manufacture than center-aligned pads. Center-aligned pads require two measured edges to define the location of the centerline so that, not only do the two edges of the edgecards have to be close to parallel to establish the centerline, but also the centerline should be perpendicular to the front edge of the edgecard that is inserted into the edgecard connector. In contrast, an edge-aligned pad requires only one edge to define the location of the pads. In addition, because the same edge is used for reference, tolerance stack-ups are minimized.

In the preferred embodiments of the present invention, the edgecard is pushed or biased to one of the edges of the connector using a biasing mechanism located in the body of the connector. The biasing mechanism does not allow the edgecard to float within the connector. This biasing creates a consistent datum at the edge of the connector so that the connector's and edgecard's dimensions can be datumed to the connector's edge, reducing manufacturing tolerances and allowing for smaller pad pitch on edgecards. Datumed to the connector's edge means, for example, that the location of the connector's contacts within the connector can be determined with respect to the connector's edge and do not have to be centered within the connector. Because the contacts are datumed to the connector's edge, the edgecard's pads can also be datumed to the connector's edge to ensure that the contacts and pads engage properly when the edgecard is inserted into the connector.

FIGS. 10-15 show a connector 10 according to the first preferred embodiment of the present invention.

The connector 10 includes a body 15 with a slot 16 and rows of contacts 11 arranged along the slot 16. Although connector 10 includes two rows of contacts 11, it is possible to only have one row of contacts 11. In this preferred embodiment, the biasing mechanism is a beam 14. The beam 14 is located in the body 15 adjacent to the slot 16 and is cantilevered such that it is biases the edgecard 10 toward one edge of the slot 16. The connector 10 is preferably mounted to a substrate (not shown), which is typically a printed circuit board.

Figure 2:
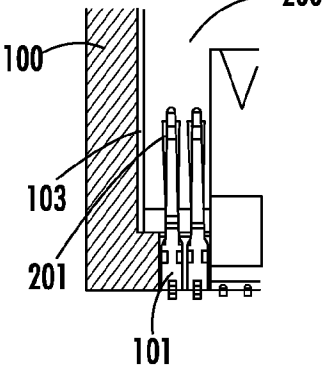
FIG. 2 PRIOR ART
FIG. 2 is a close-up partial sectional view of the prior art connector shown in FIG. 1.
Figure 3:
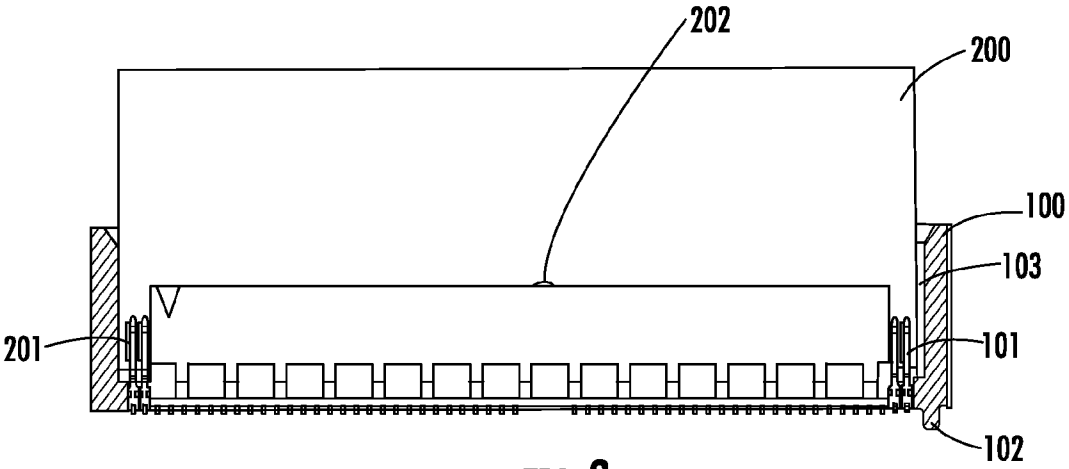
FIG. 3 PRIOR ART
FIG. 3 is a partial sectional view of a prior art connector with a shifted edgecard.
Figure 5:
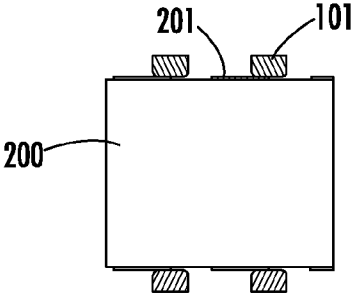
FIG. 5 PRIOR ART
FIG. 5 is top sectional view of the edgecard shown in FIG. 3.
Figure 4:
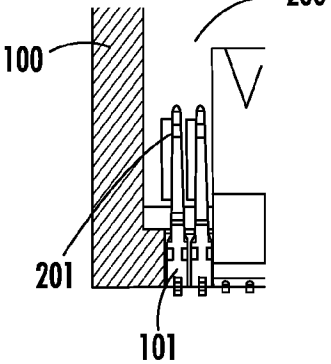
FIG. 4 PRIOR ART
FIG. 4 is a close-up partial sectional view of the prior art connector shown in FIG. 3.
Figure 6:
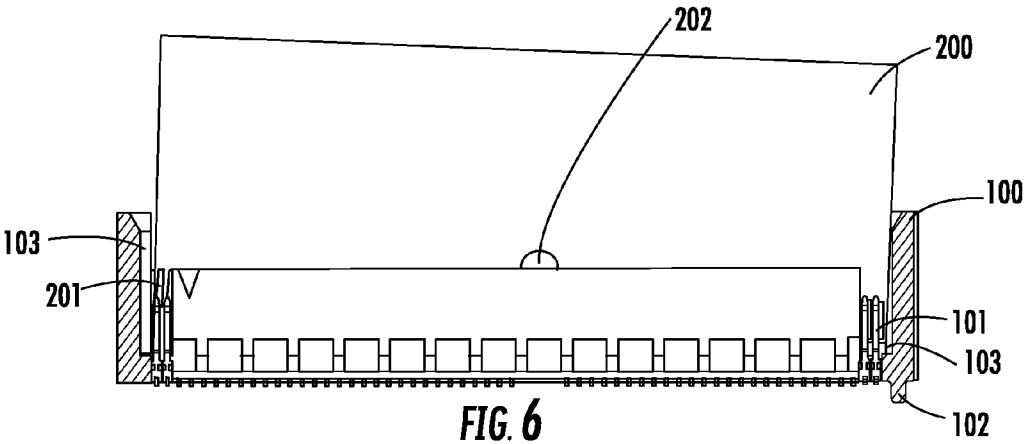
FIG. 6 PRIOR ART
FIG. 6 is a partial sectional view of a prior art connector with a skewed edgecard.
Figure 9:
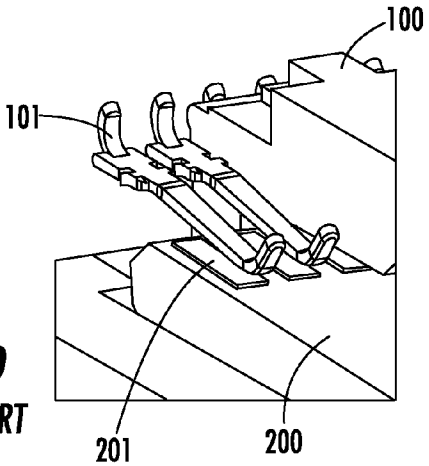
FIG. 9 PRIOR ART
FIG. 9 is a close-up sectional perspective view of the prior art connector shown in FIG. 6.
Figure 8:
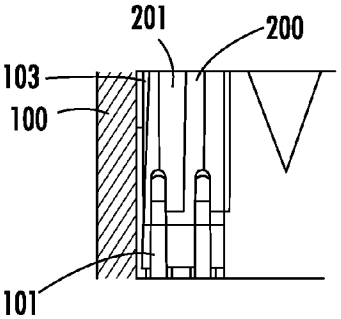
FIG. 8 PRIOR ART
FIGS. 7 and 8 are close-up partial sectional views of the prior art connector shown in FIG. 6.
Figure 7:
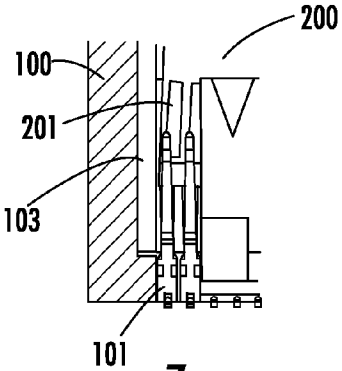
FIG. 7 PRIOR ART

The substrate 20 includes pads 21 arranged along the front edge or insertion edge. The substrate 20 preferably includes pads 21 along the edge on the top and bottom of the substrate 20; however, it is possible that the pads 21 are only arranged on the top or the bottom. As explained above, the pads 21 are preferably edge aligned so that the pads 21 are aligned with one of the edges of the edgecard. As seen, for example, in FIG. 15, the pads 21 are aligned with the left edge of the edgecard 20 that is in contact with the left edge of the slot 16 of the connector 10. The substrate 20 preferably is a printed circuit board; however, other suitable substrates could also be used. Although not shown in FIGS. 10-15, substrate 20 preferably includes a slot that is used to align the substrate 20 with the connector 10, similar to how the slot 202 in the edgecard 200 shown in FIGS. 1 and 2 aligns the edgecard 200 with the edgecard connector 100.

FIGS. 10-15 show the edgecard 20 being inserted into the connector 10. FIGS. 10 and 11 show the beginning of the insertion of the edgecard 20 when the edgecard 20 is initially centered with equal spaces 13 on both sides of the edgecard 20. The corner of the edgecard 20 is in contact with the wing 14*a* of the beam 14. Because edgecards 20 can have sharp corners that can stub the beam 14, the beam 14 preferably includes the wing 14*a* to prevent stubbing. As the edgecard is further inserted into the slot 16, the edgecard 10 is pushed toward the edge of the slot 16.

FIGS. 12 and 13 show a midpoint of the insertion of the edgecard 20 when the edge of the edgecard 20 is in contact with the first contact point 14*b* but not the second contact point 14*c*. The beam 14 pushes the edgecard 20 towards the edge of the slot 16 so that there is only a space 13 on one side of the edgecard 20. When the edgecard 10 is only in contact with the first contact point 14*b*, the beam 14 pushes with a first, smaller force. The space 13 in FIGS. 12 and 13 is twice the size of the space 13 shown in FIGS. 10 and 11. As the edgecard 10 is further inserted into the slot 16, the edgecard 10 comes into contact with the second contact point 14*c*. As shown in FIG. 13, the first contact point 14*b* is preferably arranged such that it engages with the edgecard 20 before the contacts 11 engage the pads 21.

FIGS. 14 and 15 show the edgecard 20 completely inserted in the connector 10 so that the edgecard 20 is in contact with both the first and second contact points 14*b* and 14*c*. When the edgecard 10 is in contact with the first and second contact points 14*b* and 14*c*, the beam 14 pushes with a second, larger force. The second contact point 14*c* is preferably arranged such that it engages with the edgecard 20 right before the contacts 11 engage the pads 21. This ensures that the contacts 11 and the pads 21 are properly aligned when the contacts 11 engage the pads 21 and that the contacts 11 do not get stuck on the edge of the pads 21 or between the pads 21.

The biasing mechanism preferably provides an increasing amount of force as the edgecard 20 is inserted into the slot 16 to help with insertion of the edgecard 20 and to reduce the chance of rotating the edgecard 20 due to unequal forces the ends of the edgecard 20. The force of the biasing mechanism preferably increases as the edgecard 20 is inserted into the slot 16 to ensure that the edgecard 20 is fully pressed against one edge of slot 16. In the first preferred embodiment in which the biasing mechanism is implemented as beam 14, the beam 14 includes first and second contact points 14*b* and 14*c* to provide an increasing amount of force as the edgecard 20 is inserted into the slot 16.

Figure 16:
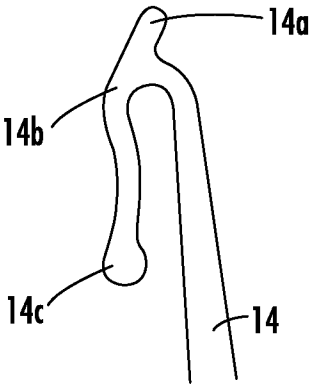
FIGS. 16-20 show close-up partial views of possible modifications of the beam according to the first preferred embodiment of the present invention.
Figure 17:
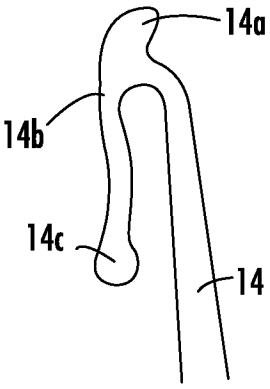
Figure 18:
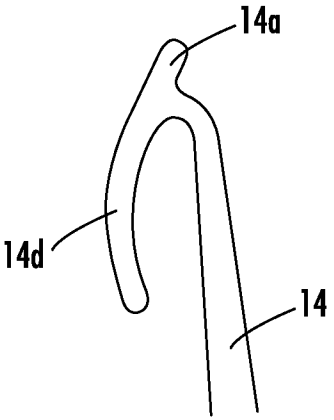

The beam 14 can have different shapes as shown in FIGS. 16-18. FIG. 16 shows a close-up partial view of the beam 14 shown in FIGS. 10-15 that includes the wing 14*a* and the first and second contact points 14*b* and 14*c*. FIG. 17 shows a similar beam 14 but with a wing 14*a* with a different shape that also prevents anti-stubbing. FIG. 18 shows a similar beam 14 but with a single point of contact 14*d*. The beam 14 of FIG. 18 is also arranged such that an increasing force is provided to the edgecard 20 as the edgecard 20 is inserted into slot 16.

Figure 19:
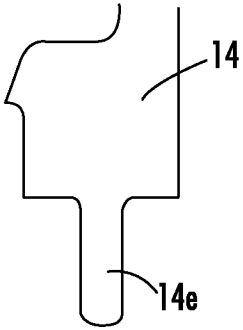
Figure 20:
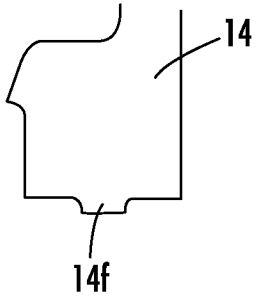
Figure 21:
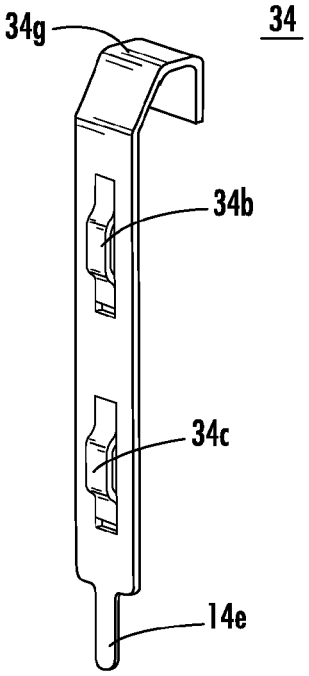
FIG. 21 is a perspective view of a beam according to a second preferred embodiment of the present invention.
Figure 22:
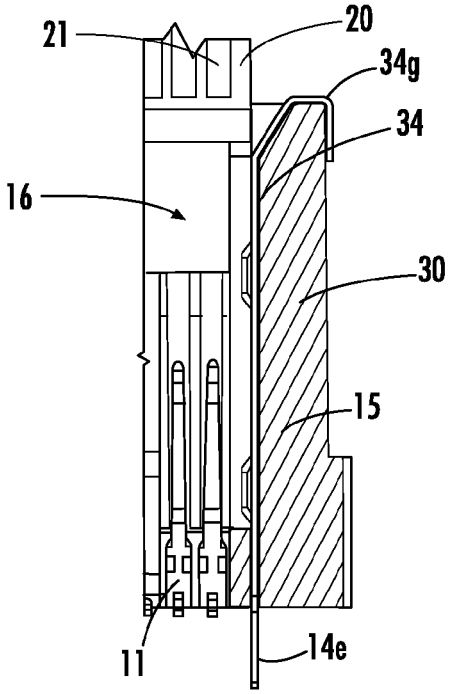
FIGS. 22-24 show a substrate being inserted into a connector according to the second preferred embodiment of the present invention.

Because the beam 14 should not move in the body 15, the beam 14 preferably includes a tail 14*e* as shown in FIG. 19. The tail 14*e* is preferably through-hole soldered to the substrate that the connector 10 is mounted on. The tail 14*e* can be used as an alignment pin. The beam 14 can also include a tail 14*f* as shown in FIG. 20 that can be surface mounted instead through-hole soldered. The tail 14*e* that is through-hole soldered provides greater securing force than the surface mounted tail 14*f*. Tails 14*e* and 14*f* can be used with any of the beams 14 shown in FIGS. 16-18.

Instead of tail 14*e* or 14*f*, the beam 14 can be secured to the body 15 in any suitable manner so that the beam 14 does not move in the body 15. For example, the beam 14 could be secured at the top of the slot 16 (not shown in FIGS. 10-15) instead at the bottom of the slot 16 (shown in FIGS. 10-15). Securing the beam 14 to the top of the slot 16 is better suited for connectors with longer slots to ensure that the edgecard is fully biased before the contacts of the connector engage the pads of the edgecard.

FIGS. 21-33 show second, third, and fourth embodiments of the present invention. The same reference numbers that are used in FIGS. 10-15 for the first preferred embodiment are used in FIGS. 21-33 for similar features.

FIGS. 21-24 show a connector 30 according to the second preferred embodiment of the present invention. The connector 30 uses beam 34 instead of beam 14. Beam 14 is preferably a flat stamping in which the edge of the stamping engages the edgecard 20. Beam 34 is also preferably a flat stamping. However, the major surfaces of beam 34 engage the edgecard 20. Beam 34 preferably includes clip 34*g* and first and second contact points 34*b* and 34*c*. Clip 34*g* connects the beam 34 to the top of the connector 30. The first and second contact points 34*b* and 34*c* are preferably cantilevered beams that extend away from a major surface of the beam 34.

Figure 23:
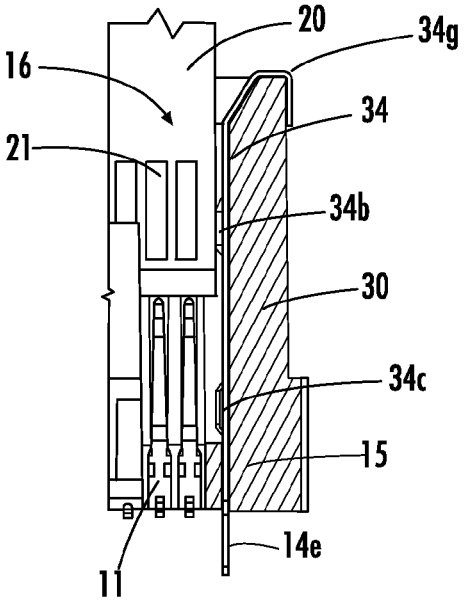
Figure 24:
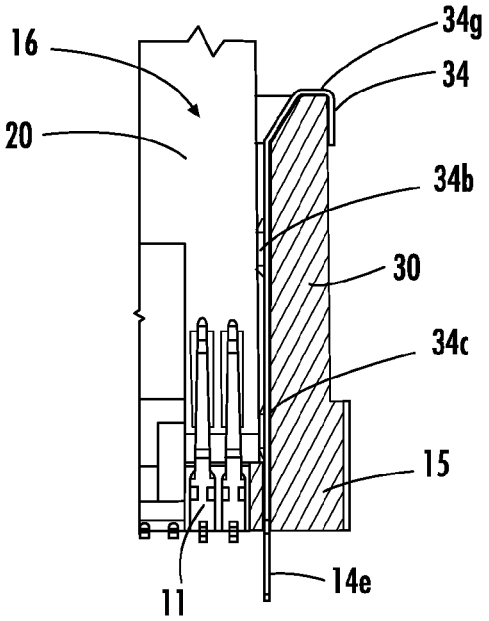
Figure 25:
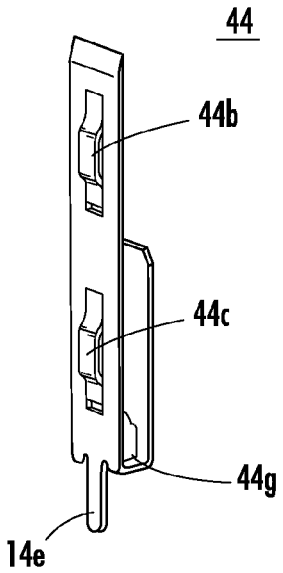
FIG. 25 is a perspective view of a beam according to a third preferred embodiment of the present invention.

FIGS. 23-24 show the edgecard 20 being inserted into the slot 16 of the connector 30. The edgecard 20 first engages the first contact point 34*b* as shown in FIG. 23 and then engages the second contact point 34*c* as shown in FIG. 24. Although not shown in FIG. 22-24, it is possible to arrange the first and second contact points 34*b* and 34*c* such that they engage the edgecard 20 before the contacts 11 engage the pads 21. It is also possible to have a single contact point and to have more than two contact points. Beam 34 could be an add-on feature that is added to a connector after the connector is manufactured, could be an integrated feature which was mechanically inserted into the connector during manufacturing, and could be an insert molded feature formed during manufacturing. Beam 34 can be made of any suitable materials, including a composite of various spring-like materials and could be made of conductive and/or non-conductive materials.

FIGS. 25-28 show a connector 40 according to the third preferred embodiment of the present invention. The second and third preferred embodiments are similar except that the third preferred embodiment includes beam 44 instead of beam 34. Beam 44 includes clip 44*g* that connects the beam 44 to the bottom of the connector 40. Beam 44 also includes first and second contact points 44*b* and 44*c* that are preferably cantilevered beams that extend away from a major surface of the beam 44.

Figure 26:
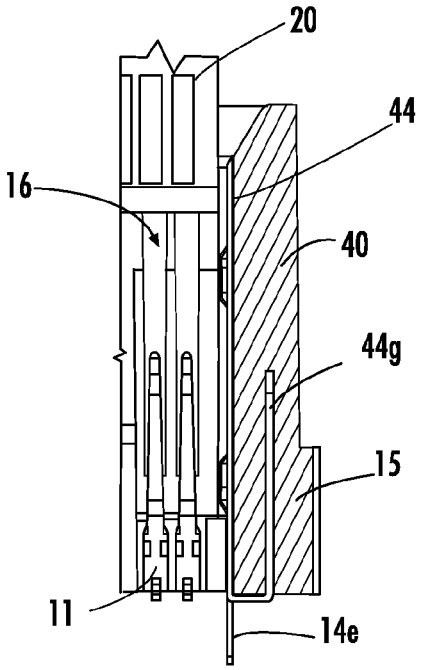
FIGS. 26-28 show a substrate being inserted into a connector according to the third preferred embodiment of the present invention.
Figure 27:
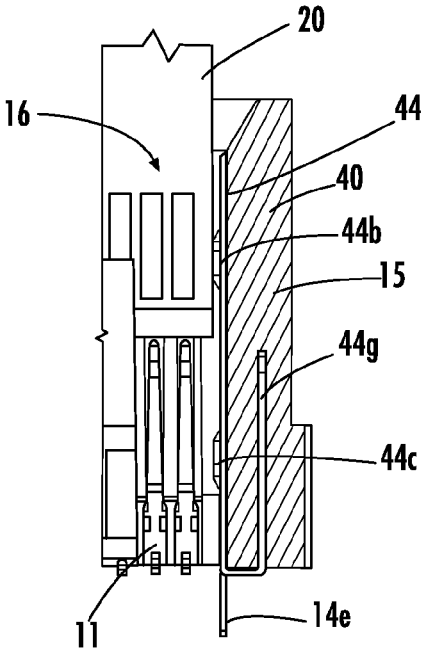
Figure 28:
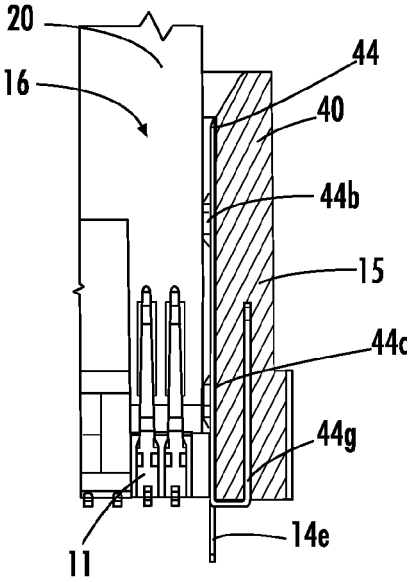
Figure 29:
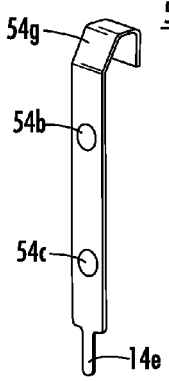
FIGS. 29 and 30 are a perspective and a side view of a beam according to a fourth preferred embodiment of the present invention.
Figure 30:
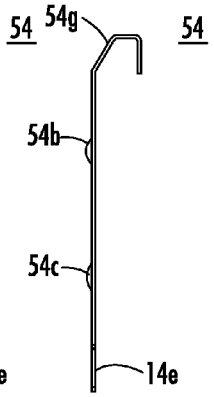

FIGS. 26-28 show the edgecard 20 being inserted into the slot 16 of the connector 40. The edgecard 20 first engages the first contact point 44*b* as shown in FIG. 27 and then engages the second contact point 44*c* as shown in FIG. 28. Although not shown in FIG. 26-28, it is possible to arrange the first and second contact points 44*b* and 44*c* such that they engage the edgecard 20 before the contacts 11 engage the pads 21. It is also possible to have a single contact point and to have more than two contact points.

Beam 44 is inserted from the bottom, and beam 34 is inserted from the top. Bottom insertion of beam 44 has the benefit of preventing beam 44 from being accidentally pulled out and of beam 44 being inserted from the same side as the contacts are normally inserted, which can speed up manufacturing. In contrast, the top insertion of beam 34 has the advantage of additional mechanical retention which prevents the plastic housing from being pulled away from the soldered contacts.

FIGS. 29-33 show a connector 50 according to the fourth preferred embodiment of the present invention. The fourth preferred embodiment is similar to the second and third preferred embodiments except that the fourth preferred embodiment includes beam 54 instead of beam 34 or 44. Beam 54 includes first and second dimples 54*b* and 54*c*. The first and second dimples 54*b* and 54*c* extend away from a major surface of the beam 54.

Figure 31:
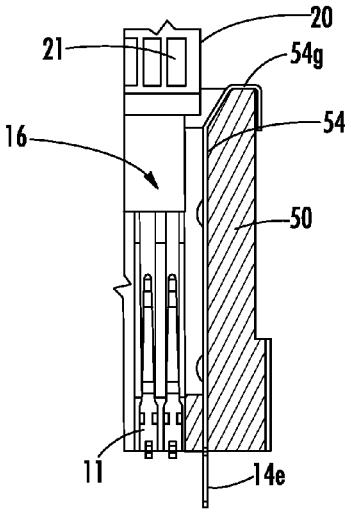
FIGS. 31-33 show a substrate being inserted into a connector according to the fourth preferred embodiment of the present invention.
Figure 32:
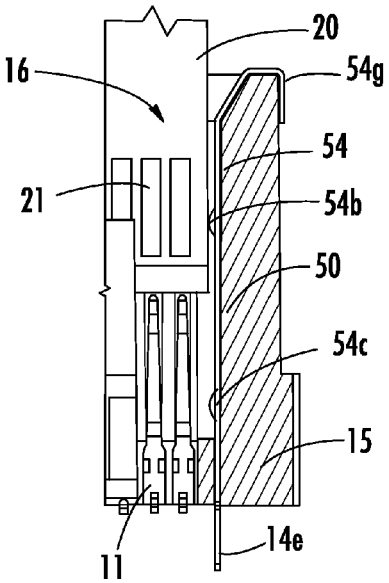
Figure 33:
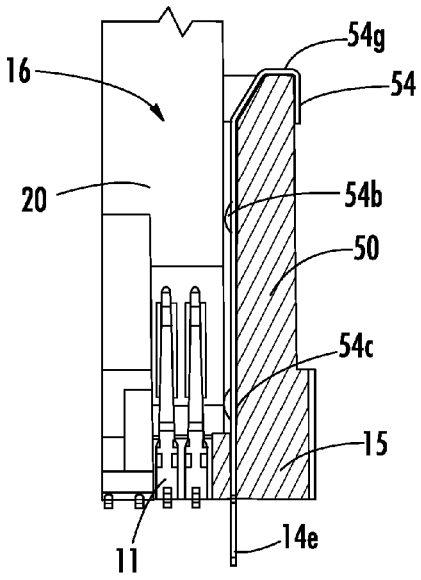

FIGS. 31-33 show the edgecard 20 being inserted into the slot 16 of the connector 50. The edgecard 20 first engages the first dimple 54*b* as shown in FIG. 32 and then engages the second dimple 54*c* as shown in FIG. 33. Although not shown in FIG. 31-33, it is possible to arrange the first and second dimples 54*b* and 54*c* such that they engage the edgecard 20 before the contacts 11 engage the pads 21. It is also possible to have a single dimple and to have more than two dimples. The dimples of the fourth preferred embodiment provide a more rigid deflection but cannot deflect to the same degree as cantilever beams for the second and third preferred embodiments.

The biasing mechanisms shown in FIGS. 10-33 are passive devices in the sense that no action by a user is required to align the edgecard. However, it is also possible that the biasing mechanism could be active devices in the sense that action by a user is required to align the edgecard. For example, a force could be provided by a lever that must be moved by a user to align the edgecard with one side of the connector.

If beams 34, 44, and 54 are made of a conductive material, then beams 34, 44, and 54 can be grounded or can provide power. Moving power away from the contacts 11 can reduce noise. Beam 44 could provide power in applications in which power is inaccessible by a user for safety reasons.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A connector comprising:

a body;

a slot within the body configured to receive a substrate and including a first end and a second end;

contacts arranged along the slot between the first end and the second end; and a biasing mechanism arranged at the first end to align the substrate as the substrate is inserted into the slot so that substrate is in contact with the second end when the substrate is fully inserted into the slot; wherein the biasing mechanism includes a through-hole solder tail.

2. A connector of claim 1, wherein the substrate is an edgecard.

3. A connector of claim 1, wherein:

the substrate includes pads; and when the substrate is fully inserted into the slot, the contacts are aligned with the pads.

4. A connector of claim 1, wherein the biasing mechanism is configured to push the substrate with increasing force as the substrate is inserted into the connector.

5. A connector of claim 1, wherein the biasing mechanism includes two contact points that engage the substrate as the substrate is inserted into the slot.

6. A connector of claim 1, wherein the biasing mechanism includes one point of contact that engages the substrate as the substrate is inserted into the slot.

7. A connector of claim 1, wherein the biasing mechanism includes an anti-stubbing wing.

8. A connector of claim 1, wherein the biasing mechanism includes a cantilevered beam.

9. A connector of claim 1, wherein the biasing mechanism includes a dimple.

10. A connector system comprising:

a mounting substrate; and a connector of claim 1 mounted to the mounting substrate.

11. A connector system comprising:

a connector of claim 1; and a substrate inserted into the slot of the substrate.

12. A connector comprising:

a body;

a slot within the body configured to receive a substrate and including a first end and a second end;

contacts arranged along the slot between the first end and the second end; and a biasing mechanism arranged at the first end to align the substrate as the substrate is inserted into the slot so that substrate is in contact with the second end when the substrate is fully inserted into the slot; wherein the biasing mechanism includes a surface-mount solder tail.

13. A connector of claim 12, wherein the substrate is an edgecard.

14. A connector of claim 12, wherein:

the substrate includes pads; and when the substrate is fully inserted into the slot, the contacts are aligned with the pads.

15. A connector of claim 12, wherein the biasing mechanism is configured to push the substrate with increasing force as the substrate is inserted into the connector.

16. A connector of claim 12, wherein the biasing mechanism includes two contact points that engage the substrate as the substrate is inserted into the slot.

17. A connector of claim 12, wherein the biasing mechanism includes one point of contact that engages the substrate as the substrate is inserted into the slot.

18. A connector of claim 12, wherein the biasing mechanism includes an anti-stubbing wing.

19. A connector of claim 12, wherein the biasing mechanism includes a cantilevered beam.

20. A connector of claim 12, wherein the biasing mechanism includes a dimple.

21. A connector system comprising:

a mounting substrate; and a connector of claim 12 mounted to the mounting substrate.

22. A connector system comprising:

a connector of claim 12; and a substrate inserted into the slot of the substrate.

* * * * *